US011067340B2

(12) United States Patent
Lee et al.

(10) Patent No.: US 11,067,340 B2
(45) Date of Patent: Jul. 20, 2021

(54) DOUBLE PIPE HEAT EXCHANGER AND METHOD FOR MANUFACTURING THE SAME

(71) Applicant: HS R & A CO., LTD, Gyeongsangnam-do (KR)

(72) Inventors: Jongkang Lee, Busan (KR); Byeongki Kang, Busan (KR); Deokhyun Lim, Gyeongsangnam-do (KR); Youngjun Kim, Gyeongsangnam-do (KR); Jiseung Ryu, Gyeongsangnam-do (KR)

(73) Assignee: HS R & A CO., LTD, Gyeongsangnam-do (KR)

( * ) Notice: Subject to any disclaimer, the term of this patent is extended or adjusted under 35 U.S.C. 154(b) by 71 days.

(21) Appl. No.: 16/388,205

(22) Filed: Apr. 18, 2019

(65) Prior Publication Data

US 2019/0242650 A1 Aug. 8, 2019

Related U.S. Application Data

(62) Division of application No. 15/584,328, filed on May 2, 2017, now abandoned.

(30) Foreign Application Priority Data

Oct. 5, 2016 (KR) ..... 10-2016-0128379

(51) Int. Cl.
*F28D 7/10* (2006.01)
*F28F 9/02* (2006.01)
(Continued)

(52) U.S. Cl.
CPC ..... *F28D 7/10* (2013.01); *F28F 1/40* (2013.01); *F28F 9/0246* (2013.01); *F28D 7/106* (2013.01); *F28D 7/14* (2013.01); *F28F 1/08* (2013.01)

(58) Field of Classification Search
CPC .... F28D 7/10; F28D 7/106; F28D 7/14; F28F 1/40; F28F 1/08; F28F 9/0246; F28F 9/04; F28F 9/14; F28F 9/16
(Continued)

(56) References Cited

U.S. PATENT DOCUMENTS 4,286,653 A 9/1981 Edwards
4,798,058 A 1/1989 Gregory
(Continued)

FOREIGN PATENT DOCUMENTS

EP 2420790 A2 2/2012
EP 2706321 A2 3/2014
(Continued)

OTHER PUBLICATIONS

Office Action, Korean Patent Application No. 10-2016-0128379, dated Oct. 20, 2016.
(Continued)

*Primary Examiner* — Henry T Crenshaw
*Assistant Examiner* — Kamran Tavakoldavani
(74) *Attorney, Agent, or Firm* — Brinks Gilson & Lione; John C. Freeman

(57) ABSTRACT

A heat exchanger and a method for manufacturing the same provides a double pipe heat exchanger including an outer pipe, an inner pipe forming a first fluid passage and a second fluid passage between the inner pipe and the outer pipe, first and second connecting pipes to pass fluid from the outside and exhaust the fluid by connecting ends of the outer pipe, and a connector to connect the inner pipe and each connecting pipe to the outer pipe. The connector includes expanded ends of the outer pipe and a reducing part configured to assemble the inner pipe inserted in the outer pipe with an end of each connecting pipe by forming at an end of each expanding part with a pressing process. The center line of
(Continued)

the inner pipe connected to the connector is disposed at an upper side of the inner circumference surface of the outer pipe.

8 Claims, 10 Drawing Sheets

(51) Int. Cl.
*F28F 1/40* (2006.01)
*F28D 7/14* (2006.01)
*F28F 1/08* (2006.01)

(58) Field of Classification Search
USPC ..... 285/123.1
See application file for complete search history.

(56) References Cited

U.S. PATENT DOCUMENTS

| | | | | |
|---|---|---|---|---|
| 6,390,137 | B1 | 5/2002 | Ewald et al. | |
| 2011/0168369 | A1* | 7/2011 | Kim | F28D 7/106 165/154 |
| 2011/0277977 | A1* | 11/2011 | Lin | F28D 15/0233 165/181 |
| 2012/0097380 | A1* | 4/2012 | Hilgert | B21D 53/06 165/177 |
| 2014/0060786 | A1* | 3/2014 | Choi | F28D 7/024 165/156 |
| 2015/0262787 | A1 | 9/2015 | Sasaki et al. | |

FOREIGN PATENT DOCUMENTS

| | | | |
|---|---|---|---|
| FR | 1516944 | A | 2/1968 |
| JP | 4018140 | | 6/1940 |
| JP | 5581659 | | 12/1953 |
| JP | 55045708 | | 3/1980 |
| JP | 60013008 | | 1/1985 |
| JP | 2001336833 | A | 12/2001 |
| JP | 2006162238 | A | 6/2006 |
| JP | 2006308028 | A | 11/2006 |
| JP | 201078171 | A | 4/2010 |
| JP | 201452176 | A | 3/2014 |
| KR | 101249721 | B1 | 4/2013 |

OTHER PUBLICATIONS

Office Action, Japanese Patent Application No. 2017-021159, dated Oct. 17, 2017.
Extended European Search Report for European Application No. 17152706.25, dated Aug. 14, 2017.

* cited by examiner

DOUBLE PIPE HEAT EXCHANGER AND METHOD FOR MANUFACTURING THE SAME

CROSS-REFERENCE TO RELATED APPLICATION(S)

This application is a divisional of U.S. application Ser. No. 15/584,328, filed May 2, 2017, which claims the benefit under 35 U.S.C. § 119(a) of Korean patent application filed on Oct. 5, 2016 in the Korean Intellectual Property Office and assigned Serial number 10-2016-0128379, the entire disclosures of which are hereby incorporated by reference.

TECHNICAL FIELD

The present invention relates to a double pipe heat exchanger and a method for manufacturing the same and, more particularly, to a double pipe heat exchanger and a method for manufacturing the same enabling a heat exchange between a fluid passing an inner pipe and a fluid passing an outer pipe in which the inner pipe is disposed.

BACKGROUND

Heat exchanges between a low temperature and a high temperature are required for various fields, and devices such as a heat exchanger can be used for exchanging heat between a high temperature fluid and a low temperature fluid. For example, in case of a refrigerator or an automobile, a double pipe structure is used for a heat exchange between a high temperature fluid and a low temperature fluid while they are passing through the double pipe structure at the same time. For example, the double pipe can be formed by combining a fluid line between a condenser and an evaporator with a suction line between the evaporator and the compressor. Therefore the low temperature fluid in the suction line can absorb heat from the high temperature fluid in the fluid line and the cooling efficiency of a cooling device can be improved. Various structural types of double pipe heat exchangers are disclosed in this field.

Conventional double pipe heat exchangers include an inner pipe and an outer pipe. A first fluid passage is formed in the inner pipe and a first fluid flows through the first fluid passage. The outer pipe is formed around the outer surface of the inner pipe. Here, a second fluid passage is formed between the inner pipe and the outer pipe, and a second fluid flows through each connecting pipe assembled with the outer pipe in the formed second fluid passage. Accordingly, a heat exchanging action is performed between the second fluid that flows through the second fluid passage and the first fluid that flows through the first fluid passage and which have different temperatures from each other.

In the meantime, separately manufactured connectors are assembled at both ends of the outer pipe in order to connect the inner pipe and each connecting pipe with the outer pipe. Here, the connectors are assembled at both ends of the outer pipe by using a braising process, and each connecting pipe is assembled/installed perpendicular to the upper or lower part of the connector by a piercing process.

The conventional double pipe heat exchanger is manufactured through a plurality of processes such as a process for manufacturing connectors separately from the outer pipe, a braising process for assembling the manufactured connector with the outer pipe, and a piercing process for assembling each connecting pipe. Accordingly, there are increases of manufacturing time and costs.

Further, there are problems in increasing the total volume of the double pipe heat exchanger and in obtaining a large installation space for the double pipe heat exchanger because each connecting pipe is assembled perpendicular to the outer pipe.

SUMMARY

The present invention has been disclosed to solve the above problems, and an object of the present invention is to provide a double pipe heat exchanger and a method for manufacturing the same so that an inner pipe and each connecting pipe can be easily assembled with an outer pipe through a simple process by forming an outer pipe integrated connector.

In order to achieve the above object, the present invention provides a double pipe heat exchanger including an outer pipe, an inner pipe configured to form a first fluid passage internally and a second fluid passage between the inner pipe and the outer pipe by inserting into the outer pipe, a first connecting pipe and a second connecting pipe configured to pass a fluid from the outside and exhaust the fluid by connecting to both ends of the outer pipe, and a connector configured to connect the inner pipe and each connecting pipe to the outer pipe. The connector includes an expanding part formed by expanding both ends of the outer pipe and a reducing part configured to assemble the inner pipe inserted in the outer pipe with an end of each connecting pipe by forming at an end of each expanding part with a pressing process. The center line of the inner pipe connected to the connector is disposed at an upper side of the inner circumference surface of the outer pipe.

Further, in order to achieve the above object, the present invention provides a method for manufacturing a double pipe heat exchanger having an outer pipe, an inner pipe configured to be formed with a first fluid passage internally and formed with a second fluid passage between the inner pipe and the outer pipe by inserting in the outer pipe, a first connecting pipe and a second connecting pipe passing a fluid from the outside and exhausting the fluid by connecting to both ends of the outer pipe, and a connector configured to connect the inner pipe and each connecting pipe to the outer pipe. The method includes the steps of (a) preparing the outer pipe and the inner pipe, (b) forming an expanding part of the connector by expanding both ends of the outer pipe, (c) forming a bend at a part of the inner pipe located at each expanding part of the outer pipe, (d) inserting the inner pipe into the outer pipe through the expanding part and inserting each connecting pipe into each expanding part of the outer pipe at the same time, (e) forming a reducing part of the connector by pressing an end of an outer circumference surface of each expanding part through a pressing process in order to assemble the inner pipe and each connecting pipe, and (f) finally fixing assembled parts of the inner pipe and each connecting pipe in the connector through a braising process.

BRIEF DESCRIPTION OF THE DRAWINGS

The above and other aspects, features, and advantages of certain embodiments of the present invention will be more apparent from the following description taken in conjunction with the accompanying drawings, in which.

DETAILED DESCRIPTION

Hereinafter, embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the disclosure.

Hereinafter, embodiments of the present invention are described with reference to the accompanying FIGS. 1 to 6.

Figure 1:
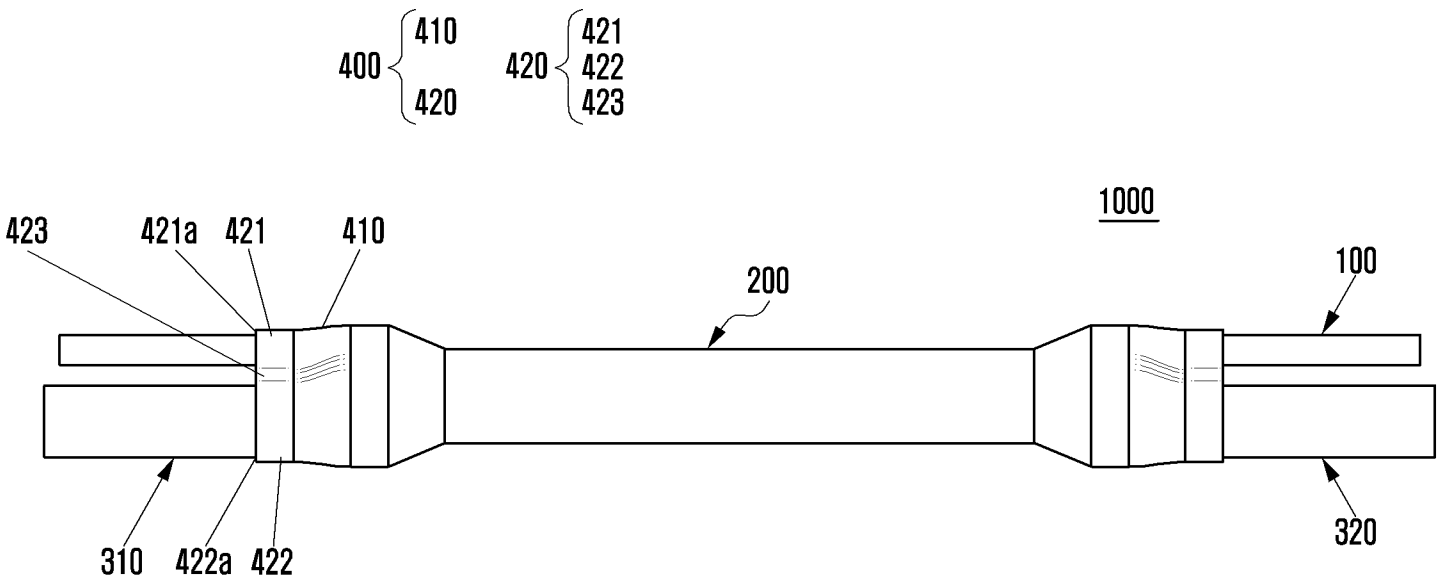
FIG. 1 is a front view illustrating a schematic structure of a double pipe heat exchanger according to an embodiment of the present invention.
Figure 2:
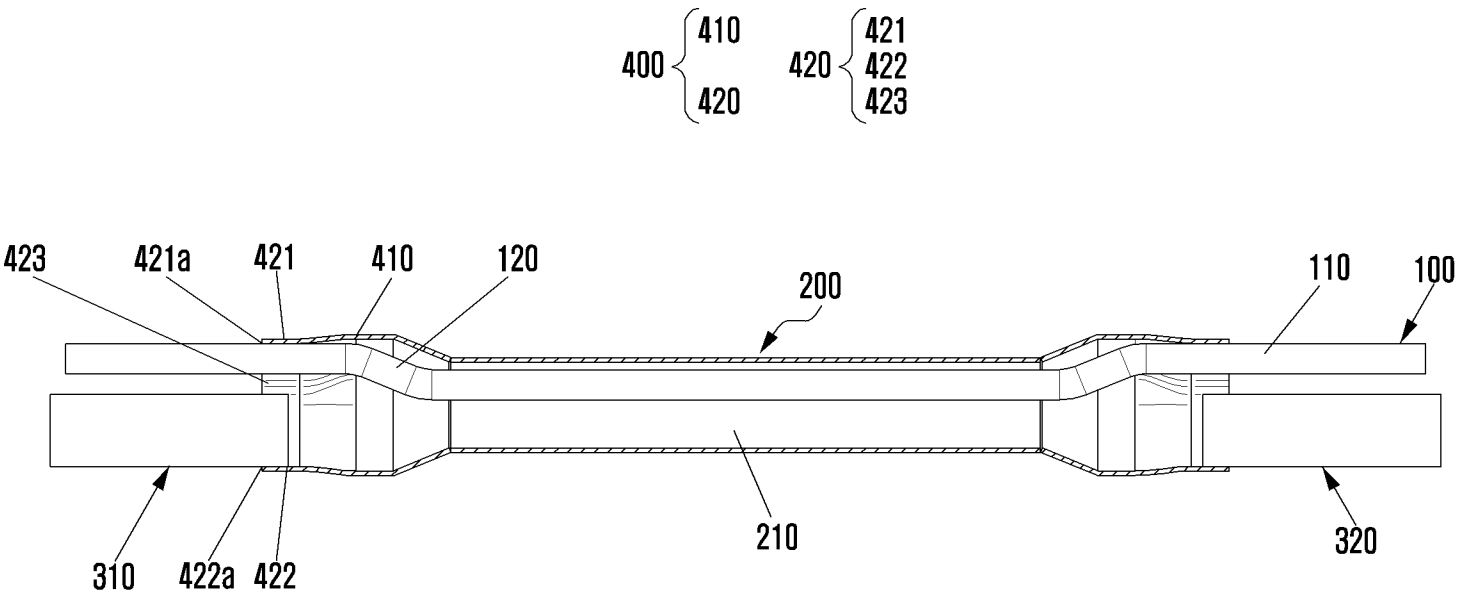
FIG. 2 is a schematic drawing illustrating an internal structure of a double pipe heat exchanger according to an embodiment of the present invention.

FIG. 1 is a front view illustrating a schematic structure of a double pipe heat exchanger according to an embodiment of the present invention; FIG. 2 is a schematic drawing illustrating an internal structure of a double pipe heat exchanger according to an embodiment of the present invention; and FIG. 3 is a perspective view illustrating a structure of an outer pipe integrated connector according to an embodiment of the present invention.

Figure 3:
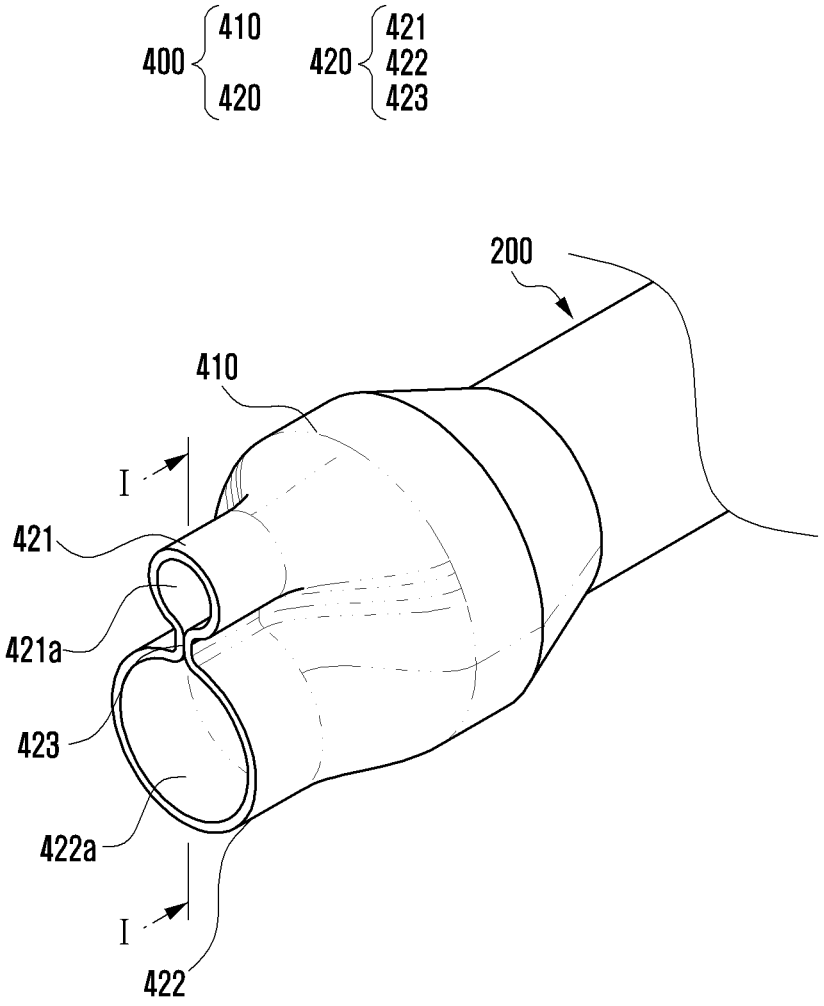
FIG. 3 is a perspective view illustrating a structure of an outer pipe integrated connector according to an embodiment of the present invention.
Figure 4:
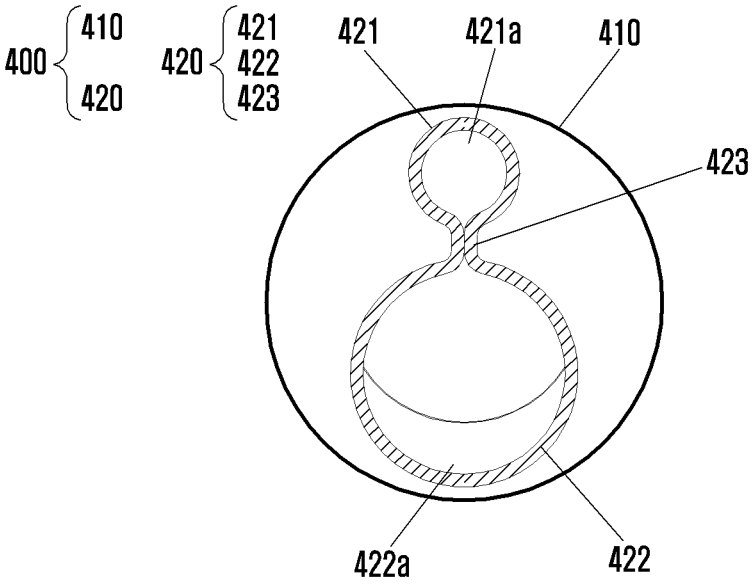
FIG. 4 is a cross-sectional view illustrating a cross section cut along the line I-I of FIG. 3.
Figure 5:
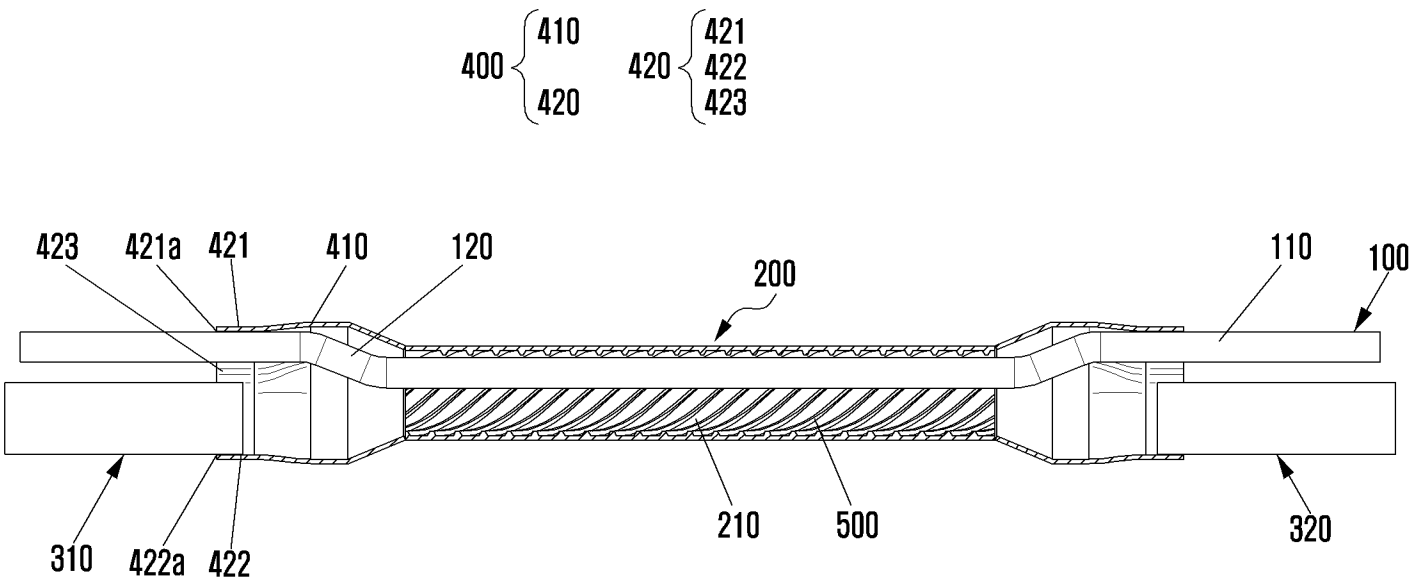
FIG. 5 is a schematic drawing illustrating an internal structure of a double pipe heat exchanger according to another embodiment of the present invention.

Further, FIG. 4 is a cross-sectional view illustrating a cross section cut along the line I-I of FIG. 3; FIG. 5 is a schematic drawing illustrating an internal structure of a double pipe heat exchanger according to another embodiment of the present invention; and FIGS. 6A to 6F are schematic drawings illustrating a method for manufacturing a double pipe heat exchanger in steps according to the present invention.

With reference to FIGS. 1 and 2, the double pipe heat exchanger 1000 according to an embodiment of the present invention may include an inner pipe 100 forming a first fluid passage 110 internally, outer pipe 200 accommodating the inner pipe 100 internally and forming a second fluid passage 210 between the inner pipe 100 and the outer pipe 200, first connecting pipe 310 and second connecting pipe 320 for passing a fluid from the outside and exhausting the fluid by connecting both ends of the outer pipe 200, and connector 400 for connecting the inner pipe 100 and each connecting pipe 310 and 320 to the outer pipe 200.

The inner pipe 100 passes a first fluid through the first fluid passage 110. Here, the first fluid may be a low temperature refrigerant suctioned by a compressor in an automobile cooling device or a high temperature fluid supplied to an inlet of an expanding valve.

The outer pipe 200 is manufactured separately from the inner pipe 100 in a size that the inner pipe 100 can be inserted into the outer pipe 200. Normally, the inner diameter of the outer pipe 200 is designed greater than the outer diameter of the inner pipe 100 to form a gap with an assembly allowance between the inner pipe 100 and the outer pipe 200, and thereby the inner pipe 100 and the outer pipe 200 can be smoothly assembled through the formed gap.

If the inner pipe 100 is inserted into the outer pipe 200, a second fluid passage 210 is formed between the inner pipe 100 and the outer pipe 200. Such a second fluid passage 210 becomes a fluid passage in which a second fluid is flowing. The second fluid has different characteristics from the first fluid, which may be a low temperature refrigerant suctioned by an automobile cooling device or a high temperature fluid supplied to an inlet of an expanding valve. If the first fluid supplied to the inner pipe 100 is a low temperature refrigerant, the second fluid becomes a high temperature refrigerant; and if the first fluid supplied to the inner pipe 100 is a high temperature refrigerant, the second fluid becomes a low temperature refrigerant. The first and second fluids may be different fluids having different physical characteristics for transferring heat, and they may not be a refrigerant satisfying a specific temperature/pressure condition.

FIGS. 3 and 4 illustrate a connector 400 according to an embodiment of the present invention that is formed integrally at both ends of the outer pipe 200. Here, the connector 400 may be assembled with the first connecting pipe 310 and the second connecting pipe 320 so that an external fluid can flow in and out.

In the meantime, the first connecting pipe 310 may be an exhaust pipe for exhausting the fluid, and the second connecting pipe 320 may be an inflow pipe for passing the fluid.

In more detail, the connector 400 according to an embodiment of the present invention is formed by a pressing process in a state that both ends of the outer pipe 200 are expanded, and the connector 400 takes the role of combining the inner pipe 100 and each connecting pipe 310 and 320 inserted in the outer pipe 200.

Such a connector 400 may include an expanding part 410 formed by expanding both ends of the outer pipe 200 and a reducing part 420 for combining ends of the inner pipe 100 and each connecting pipe 310 and 320 inserted in the outer pipe 200 by pressing an end of each expanding part 410 through a pressing process.

Here, each reducing part 420 may include a first reducing part 421 formed with a first coupling hole 421*a* for inserting and combining the inner pipe 100, and a second reducing part 422 formed at an end of first reducing part 421 with a second coupling hole 422*a* for combining an end of each connecting pipe 310 and 320.

In more detail, the connector 400 according to an embodiment of the present invention is an outer pipe integrated connector manufactured by using both ends of the outer pipe 200. An expanding part 410 is formed by expanding both ends of the outer pipe 200, and the inner pipe 100 is disposed in the outer pipe 200 by inserting into the outer pipe 200 through the upper part of the expanding part 410. If an end of each expanding part 410 is pressed by a pressing process in a state that an end of each connecting pipe 310 and 320 is combined with the lower part of the expanding part 410, a first reducing part 421 is formed with a first coupling hole 421*a* for inserting and combining the inner pipe 100. Subsequently, the outer pipe integrated connector 400 can be manufactured by forming a reducing part 420 including a second reducing part 422 provided with a second coupling hole 422*a* for combining each connecting pipe 310 and 320.

In the meantime, a separating part 423 can be formed between the first reducing part 421 combined with the inner pipe 100 and the second reducing part 422 combined with the end of each connecting pipe 310 and 320 to separate the reducing parts from each other.

Differently from the conventional method, the connector 400 according to an embodiment of the present invention can save manufacturing time and costs by manufacture of the connector 400 separately from the outer pipe because the braising process for combining both ends of the outer pipe 200 and the piercing process for combining each connecting pipe are unnecessary.

In the meantime, the center line of the inner pipe 100 located at a connecting part of the connector 400 may be disposed at the upper side of the inner circumference surface of the outer pipe 200. For this, the inner pipe 100 according to an embodiment of the present invention may further include a bend 120.

In more detail, the bend 120 is formed at both ends of the inner pipe 100 located in each connector 400 so that the inner pipe 100 can be disposed parallel to the outer pipe 200 by inserting into the outer pipe 200 in the lengthwise direction, and the bend 120 can be formed in a curved shape along the inner circumference surface of the expanding part 410.

Namely, by forming the bend 120 so that a part of the inner pipe 100 located in the outer pipe 200 has a stepped part corresponding to a part of each inner pipe 100 located at each connector 400. The inner pipe 100 can be disposed parallel to the outer pipe 200 by inserting into the outer pipe 200 in the lengthwise direction. Here, each connecting pipe 310 and 320 is combined with the outer pipe 200 parallel to an identical line, and can be disposed parallel to the inner pipe 100 exposed at both ends of the outer pipe 200.

Accordingly, the double pipe heat exchanger 1000 according to an embodiment of the present invention has an installation structure such that the inner pipe 100 and the outer pipe 200 are extended in a parallel state and, thereby, can reduce the total volume and installation space compared with the conventional structure wherein each connecting pipe 310 and 320 is installed perpendicular to the outer pipe 200.

Hereinafter, a structure of a double pipe heat exchanger 1000 according to an embodiment of the present invention is described with reference to FIG. 5.

A double pipe heat exchanger 1000 according to another embodiment of the present invention is suggested to form a spiral part 500 in the outer pipe 200. In another embodiment of the present invention, detailed descriptions on the structures of the suggested outer pipe 200, inner pipe 100, each connecting pipe 310 and 320, and connector 400 are identical to the above embodiment.

In more detail, according to another embodiment of the present invention, a plurality of spiral parts 500 can be formed at the inner circumference surface of the outer pipe 200 in the lengthwise direction so that at least a portion of the second fluid passage 210 is formed in a spiral shape. Here, the second fluid passage 210 becomes to have a spiral structure according to the spiral part 500.

Namely, if the spiral part 500 is formed at the inner circumference surface of the outer pipe 200, the spiral part 500 enlarges the surface area of the outer pipe 200 and extends the flow time of the second fluid. Accordingly, the heat exchange efficiency between the second fluid flowing through the second fluid passage 210 and the first fluid flowing through the first fluid passage 110 can be increased.

Hereinafter, a method for manufacturing a double pipe heat exchanger 1000 according to an embodiment of the present invention is described.

In the method for manufacturing a double pipe heat exchanger 1000 according to an embodiment of the present invention, the double pipe heat exchanger may include an outer pipe 200, an inner pipe 100 configured to form a first fluid passage 110 internally and a second fluid passage 210 between the inner pipe 100 and the outer pipe 200 by inserting into the outer pipe 200, a first connecting pipe 310 and a second connecting pipe 320 configured to pass a fluid from the outside and exhaust the fluid by connecting to both ends of the outer pipe 200, and a connector 400 configured to connect the inner pipe 100 and each connecting pipe 310 and 320 to the outer pipe 200. The method may include the steps of (a) preparing the outer pipe 200 and the inner pipe 100, (b) forming an expanding part 410 of the connector 400 by expanding both ends of the outer pipe 200, (c) forming a bend 120 at parts of the inner pipe 100 located at each expanding part 410 of the outer pipe 200, (d) inserting the inner pipe 100 into the outer pipe 200 through the expanding part 410 and inserting each connecting pipe 310 and 320 into each expanding part 410 of the outer pipe 200 at the same time, (e) forming a reducing part 420 of the connector 400 by pressing an end of an outer circumference surface of each expanding part 410 through a pressing process in order to assemble the inner pipe 100 and each connecting pipe 310 and 320, and (f) finally fixing assembled parts of the inner pipe 100 and each connecting pipe 310 and 320 in the connector 400 through a braising process.

At step (c), the bend 120 can be formed in a curved shape along the inner circumference surface of the expanding part 410 so that a part of the inner pipe 100 located in the outer pipe 200 has a stepped part in the lower direction corresponding to a part of each inner pipe 100 located in each connector 400.

Further, at step (e), the reducing part 420 may include a first reducing part 421 configured with a first coupling hole 421*a* assembled by inserting into the inner pipe 100, a second reducing part 422 formed at an end of the first reducing part 421 and configured with a second coupling hole 422*a* for assembling ends of each connecting pipe 310 and 320, and a separating part 423 formed between the first reducing part 421 and the second reducing part 422 and configured to separate the first reducing part 421 and the second reducing part 422.

After step (a), a step of forming a plurality of spiral parts 500 in a spiral shape along the lengthwise direction of the inner circumference surface in the outer pipe 200 is further included so that at least a portion of the second fluid passage 210 has a spiral shape.

Hereinafter, a detailed procedure of manufacturing a double pipe heat exchanger 1000 according to an embodiment of the present invention is described with reference to FIGS. 6A to 6E.

Figure 6A:
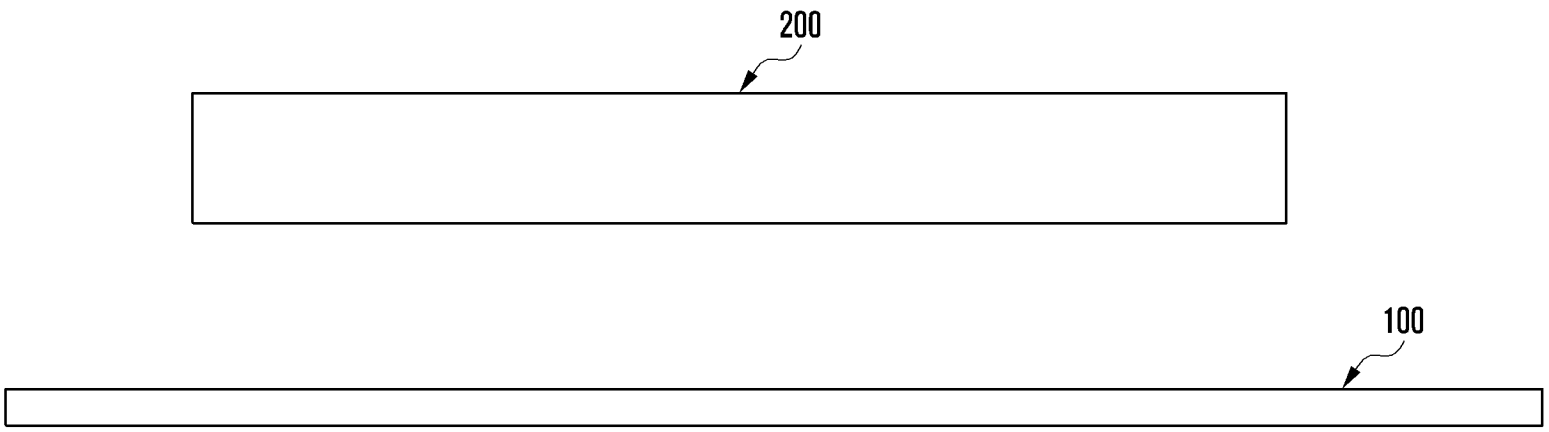
FIGS. 6A to 6E are schematic drawings illustrating a method for manufacturing a double pipe heat exchanger in steps according to the present invention.
Figure 6B:
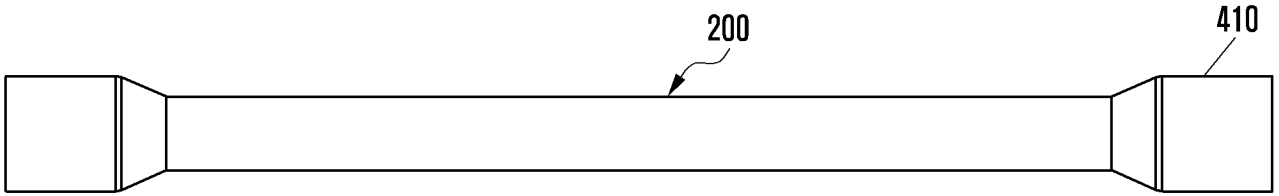
Figure 6C:
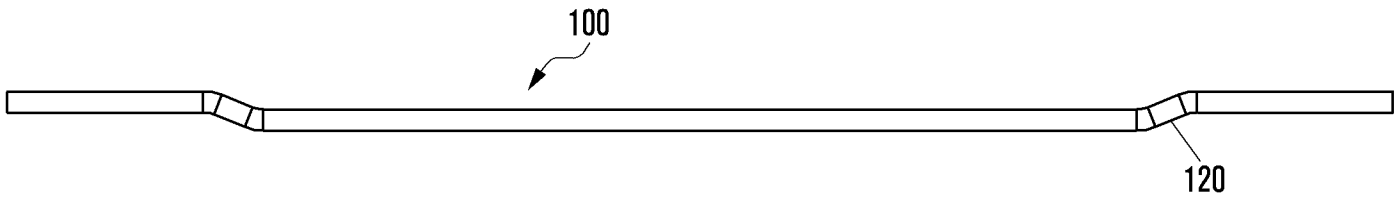

Here, FIG. 6A illustrates a state that the inner pipe 100 and the outer pipe 200 are prepared, FIG. 6B illustrates a state that the expanding part 410 is formed at the inner pipe 100, and FIG. 6C illustrates a state that the bend 120 is formed at both ends of the inner pipe 100.

Figure 6D:
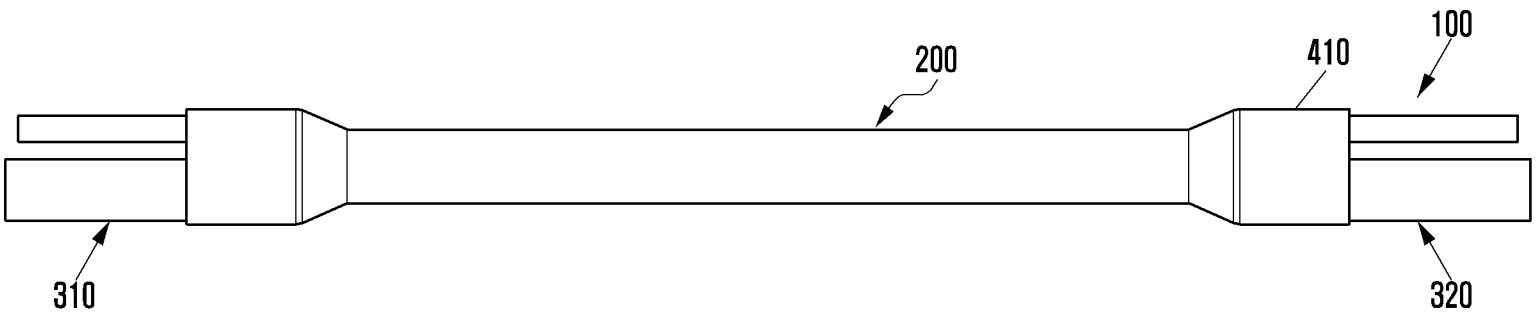
Figure 6E:
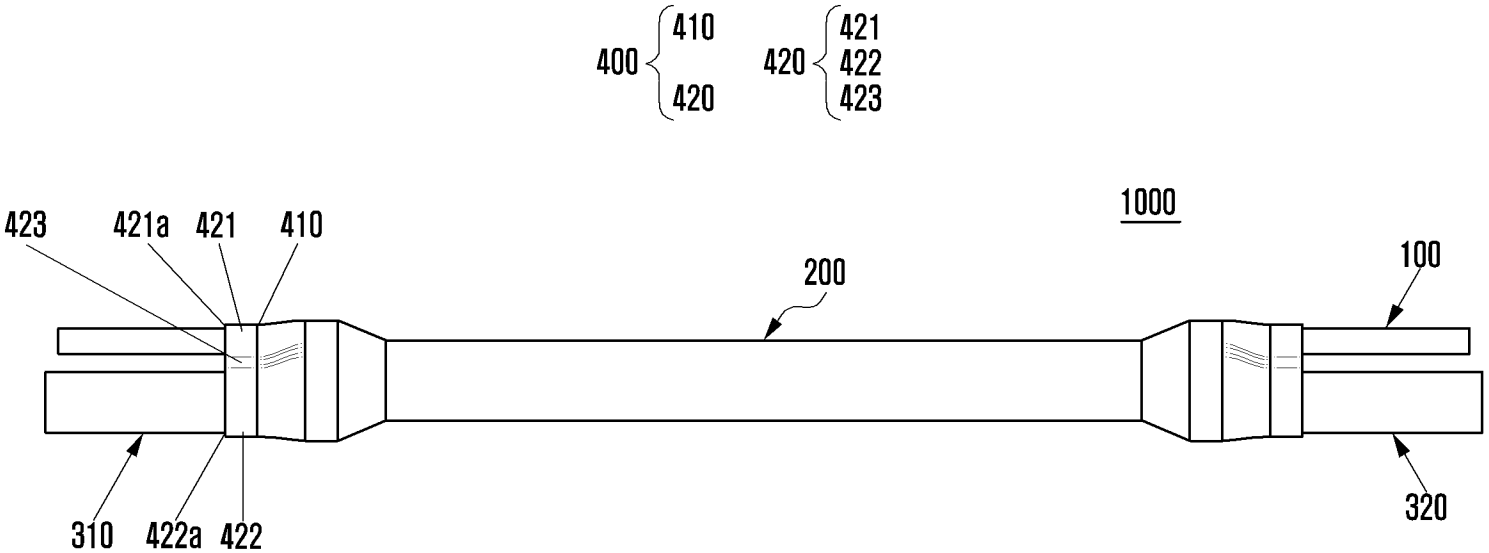

Further, FIG. 6D illustrates a state that the inner pipe 100 and each connecting pipe 310 and 320 are inserted in the outer pipe 200, and FIG. 6E illustrates a state that the connector 400 is formed with the reducing part 420 by pressing an end of the expanding part 410.

In the method for manufacturing a double pipe heat exchanger 1000 according to an embodiment of the present invention, an inner pipe 100 and an outer pipe 200 are prepared firstly as shown in FIG. 6A.

If the preparation of the inner pipe 100 and the outer pipe 200 is completed, an expanding part 410 of the connector is formed at both ends of the outer pipe as shown in FIG. 6B. Here, the expanding part 410 can be formed by a forming process.

Subsequently, a bend 120 is formed at a part of the inner pipe 100 that will be located at the expanding part 410 of each connector 400 of the outer pipe 200 as shown in FIG. 6C. Here, each bend 120 can be formed in a curved shape along the inner circumference surface of the expanding part 410 so that the part of the inner pipe located in the outer pipe 200 has a stepped part corresponding to the part of each inner pipe 100 located in the connector 400. Accordingly, the inner pipe 100 can be disposed parallel to the outer pipe 200 by inserting into the outer pipe 200 in the lengthwise direction.

Although not shown in the drawing, an ultrasonic cleaning process can be performed to clean the outer pipe 200 formed with the expanding part 220 and the inner pipe 100 formed with the bend 120. Namely, the ultrasonic cleaning is performed to remove foreign substances generated in the procedure of processing the outer pipe 200 and the inner pipe 100.

In the embodiments of the present invention, the expanding part 410 has been described as being formed at the outer pipe 200 first and the bend 120 has been described as being formed at the inner pipe 100 subsequently; however, the two processes can be performed at the same time or the forming of the inner pipe 100 can be performed first according to the manufacturing method of the double pipe heat exchanger.

Subsequently, the inner pipe 100 is inserted into the outer pipe 200 through an end of the expanding part 410 as shown in FIG. 6D. Here, the inner pipe 100 is inserted into the outer pipe 200 so that both ends of the inner pipe 100 are exposed to the outside of the outer pipe 200. At the same time, an end of each connecting pipe 310 and 320 is inserted into both ends of the expanding part 410.

Here, each connecting pipe 310 and 320 can be combined parallel to the outer pipe 200 and disposed parallel to the inner pipe 100 exposed to both ends of the outer pipe 200.

Accordingly, the inner pipe 100 and each connecting pipe 310 and 320 are installed by extending parallel to the outer pipe 200, and thereby the total volume and installation space of the double pipe heat exchanger 1000 can be reduced compared with the conventional structure wherein each connecting pipe is installed perpendicular to the outer pipe.

Subsequently, as shown in FIG. 6E, the reducing part 420 of the connector 400 is formed to combine the inner pipe 100 and each connecting pipe 310 and 320 with the outer pipe 200 by pressing the outer circumference surface of the expanding part 220 in a state that the inner pipe 100 and each connecting pipe 310 and 320 are inserted into the outer pipe 200.

Here, in the process of forming the reducing part 420 by pressing an end of each expanding part 410, a separating part 423 is formed to separate the inner pipe 100 inserted in the expanding part 410 and each connecting pipe 310 and 320 combined with the expanding part 220. A first reducing part 421 provided with a first coupling hole 421*a* is formed at the upper part of the separating part 423 to insert the inner pipe 100 and a second reducing part 422 provided with a second coupling hole 422*a* is formed at the lower part of the separating part 423 to insert each connecting pipe 310 and 320.

Subsequently, although not shown in the drawing, the inner pipe 100 and each connecting pipe 310 and 320 can be finally combined with the outer pipe 200 by attaching each coupling hole 421*a* and 422*a* of the first reducing part 421 and the second reducing part 422 to the inner pipe 100 and each connecting pipe 310 and 320 through a braising process.

Although not shown in the drawing, after step (a), a step of forming a plurality of spiral parts 500 may be further included so that at least a portion of the second fluid passage 210 becomes to have a spiral shape by forming a spiral at the inner circumference surface of the outer pipe 200 in the lengthwise direction.

Namely, if the spiral part 500 is formed at the inner circumference surface of the outer pipe 200, the spiral part 500 enlarges the surface area of the outer pipe 200 and extends the flow time of the second fluid. Accordingly, the heat exchange efficiency between the second fluid flowing through the second fluid passage 210 and the first fluid flowing through the first fluid passage 110 can be improved.

The manufacture of the double pipe heat exchanger 1000 is completed through the above process.

According to a double pipe heat exchanger and a method for manufacturing the same in the present invention, an effect of combining an inner pipe and a connecting pipe easily through a simple process can be provided by forming an outer pipe integrated connector for combining an inner pipe and each connecting pipe with both ends of an outer pipe.

Accordingly, an effect of reducing the manufacturing time and costs can be provided because a piercing process for combining each connecting pipe is unnecessary and a braising process for combining a connector and an outer pipe can be simplified.

Further, according to the present invention, an effect of securing the minimum installation space by reducing the volume of the double pipe heat exchanger by forming a bend at both ends of the inner pipe, combining the inner pipe parallel to the outer pipe, and combining each connecting pipe parallel on an identical line.

Further, according to the present invention, an effect of greatly improving the heat exchange efficiency can be provided because a flow rate of a second fluid flowing through a second fluid passage can be increased by forming a spiral part at the inner circumference surface of the outer pipe and an heat exchange area between a first fluid flowing through a first fluid passage and the second fluid flowing through the second fluid passage can be increased accordingly.

While the present invention has been shown and described with reference to various embodiments thereof, it will be understood by those skilled in the art that various changes in form and details may be made therein without departing from the spirit and scope of the present invention as defined by the appended claims and their equivalents.

The invention claimed is:

1. A double pipe heat exchanger comprising:

an outer pipe;

an inner pipe configured to form a first fluid passage internally and a second fluid passage between the inner pipe and the outer pipe by inserting the inner pipe into the outer pipe;

a first connecting pipe and a second connecting pipe configured to pass a fluid from an outside and exhaust the fluid by connecting to both ends of the outer pipe; and a connector configured to connect the inner pipe, the first connecting pipe, and the outer pipe; wherein the connector comprises:

an expanding part formed by expanding an end of the outer pipe; and a reducing part configured to assemble the inner pipe inserted in the outer pipe with an end of the first connecting pipe and by forming at an end of the expanding part, wherein a center line of the inner pipe connected to the connector is disposed at an upper side of an inner circumference surface of the outer pipe; and a plurality of spiral parts formed in a spiral shape along a lengthwise direction of the inner circumference surface of the outer pipe and are further composed in the outer pipe so that the second fluid passage has a spiral shape at least partially;

wherein the reducing part comprises:

a first reducing part configured with a first coupling hole assembled by inserting into the inner pipe;

a second reducing part formed at an end of the first reducing part and configured with a second coupling hole for assembling the end of the first connecting pipe; and a separating part formed between the first reducing part and the second reducing part, and configured to separate the first reducing part and the second reducing part.

2. The double pipe heat exchanger of claim 1, further comprising: a bend formed at an end of the inner pipe located in an expanding part of the connector in a curved shape along an inner circumference surface of the expanding part so that the inner pipe can be disposed parallel to the outer pipe by inserting the inner pipe into the outer pipe in the lengthwise direction.

3. The double pipe heat exchanger of claim 2, wherein the first connecting pipe and the second connecting pipe are assembled parallel to the outer pipe and disposed parallel to the inner pipe exposed from both ends of the outer pipe.

4. The double pipe heat exchanger of claim 1, further comprising a second connector configured to connect the inner pipe, the second connecting pipe, and the outer pipe; wherein the second connector comprises:

a second expanding part formed by expanding a second end of the outer pipe; and a second reducing part configured to assemble the inner pipe inserted in the outer pipe with an end of the second connecting pipe and by forming at an end of the second expanding part.

5. The double pipe heat exchanger of claim 4, wherein the second reducing part comprises:

a third reducing part configured with a third coupling hole assembled by inserting into the inner pipe; and a fourth reducing part formed at an end of the third reducing part and configured with a fourth coupling hole for assembling the end of the second connecting pipe; and a second separating part formed between the third reducing part and the fourth reducing part, and configured to separate the third reducing part and the fourth reducing part.

6. A method for manufacturing a double pipe heat exchanger having an outer pipe, an inner pipe configured to be formed with a first fluid passage internally and formed with a second fluid passage between the inner pipe and the outer pipe by inserting in the outer pipe, a first connecting pipe and a second connecting pipe passing a fluid from the outside and exhausting the fluid by connecting to both ends of the outer pipe, and a connector configured to connect the inner pipe and each connecting pipe and to the outer pipe, the method comprising the steps of: (a) preparing the outer pipe and the inner pipe; (b) forming a plurality of spiral parts in a spiral shape along the lengthwise direction of the inner circumference surface in the outer pipe so that at least a portion of the second fluid passage has a spiral shape; (c) forming an expanding part of the connector by expanding both ends of the outer pipe: (d) forming a bend at parts of the inner pipe located at each expanding part of the outer pipe; (e) inserting the inner pipe into the outer pipe through the expanding part and inserting each connecting pipe and into each expanding part of the outer pipe at the same time; (f) forming a reducing part of the connector by pressing an end of an outer circumference surface of each expanding part through a pressing process in order to assemble the inner pipe and each connecting pipe and; and (g) finally fixing assembled parts of the inner pipe and each connecting pipe and in the connector through a braising process.

7. The method of claim 6, wherein, at the step (d), the bend is formed in a curved shape along the inner circumference surface of the expanding part so that a part of the inner pipe located in the outer pipe has a stepped part in the lower direction corresponding to a part of each inner pipe located in each connector.

8. The method of claim 7, wherein, at the step (f), the reducing part comprises: a first reducing part configured with a first coupling hole assembled by inserting into the inner pipe; a second reducing part formed at an end of the first reducing part and configured with a second coupling hole for assembling ends of each connecting pipe and; and a separating part formed between the first reducing part and the second reducing part, and configured to separate the first reducing part and the second reducing part.

* * * * *